US005571287A

United States Patent [19]

Subramanyam et al.

[11] Patent Number: 5,571,287

[45] Date of Patent: Nov. 5, 1996

[54] SOAP COMPOSITION CONTAINING SODIUM PYROPHOSPHATE

[75] Inventors: Ravi Subramanyam, North Brunswick, N.J.; Syed H. Abbas, Maharashtra, India.; Suman K. Chopra, Dayton, N.J.

[73] Assignee: Colgate-Palmolive Company, New York, N.Y.

[21] Appl. No.: 289,956

[22] Filed: Aug. 12, 1994

Related U.S. Application Data

[63] Continuation-in-part of Ser. No. 3,152, Jan. 11, 1993, abandoned.

[51] Int. Cl.[6] ..... C11D 9/08; C11D 17/00

[52] U.S. Cl. ..... 510/150; 134/42

[58] Field of Search ..... 252/DIG. 16, 108, 252/135, 174, 134, 109, 89.1, DIG. 5; 134/42

[56] References Cited

U.S. PATENT DOCUMENTS

| | | | |
|---|---|---|---|
| 2,093,927 | 9/1937 | Preston | 87/5 |
| 2,277,730 | 3/1942 | Thomas et al. | 252/109 |
| 2,310,475 | 2/1943 | Thomas et al. | 252/109 |
| 2,686,761 | 8/1954 | Ferguson et al. | 252/109 |
| 2,868,731 | 1/1959 | Henderson et al. | 252/117 |
| 2,941,948 | 6/1960 | Blinka et al. | 252/138 |
| 2,970,116 | 1/1961 | Kelly et al. | 252/368 |
| 3,043,779 | 7/1962 | Parke et al. | 252/117 |
| 3,178,370 | 4/1965 | Okenfuss | 252/137 |
| 3,274,119 | 9/1966 | Goldwasser et al. | 252/368 |
| 3,344,076 | 9/1967 | Wilcox, Jr. | 252/135 |
| 3,370,015 | 2/1968 | van Kampen et al. | 252/137 |
| 3,494,869 | 2/1970 | Armstrong | 252/109 |
| 3,562,167 | 2/1971 | Kamen et al. | 252/121 |
| 3,576,749 | 4/1971 | Megson et al. | 252/132 |
| 3,639,286 | 2/1972 | Ballestra et al. | 252/109 |
| 3,793,214 | 2/1974 | O'Neill et al. | 252/117 |
| 3,798,181 | 3/1974 | Vazquez | 252/539 |
| 3,816,321 | 6/1974 | Kleinschmidt | 252/174 |
| 3,844,952 | 10/1974 | Booth | 252/108 |
| 4,007,124 | 2/1977 | Collier et al. | 252/109 |
| 4,150,001 | 4/1979 | Sen | 252/539 |
| 4,203,857 | 5/1980 | Dugan | 252/108 |
| 4,297,230 | 10/1981 | Rasser | 252/108 |
| 4,308,158 | 12/1981 | Gohla et al. | 252/97 |
| 4,543,204 | 9/1985 | Gervasio | 252/DIG. 16 |
| 4,678,593 | 7/1987 | Ridley | 252/174 |
| 4,719,030 | 1/1988 | Williams et al. | 252/108 |
| 4,851,137 | 7/1989 | Weinstein | 252/174 |
| 4,985,170 | 1/1991 | Dawson et al. | 252/108 |

FOREIGN PATENT DOCUMENTS

| | | |
|---|---|---|
| 0602461 | 4/1990 | Australia . |
| 580206 | 7/1959 | Canada . |
| 157274 | 2/1986 | India. . |
| 0718559 | 11/1954 | United Kingdom . |
| 2231882 | 11/1990 | United Kingdom . |

*Primary Examiner*—Paul Lieberman
*Assistant Examiner*—Caroline L. Dusheck
*Attorney, Agent, or Firm*—Martin B. Barancik; James M. Serafino

[57] ABSTRACT

A detergent soap composition in bar form comprising (1) an alkali metal or ammonium soap of a saturated or unsaturated fatty acid or mixture thereof, (2) a moisture content in the range of 6–14% by weight of total water, and (3) from about 0.5 to about 15% by weight of a structurant selected from the group consisting of tetrasodium pyrophosphate, a hydrate of tetrasodium pyrophosphate (TSPP) and mixtures thereof. The structurant provides enhanced structural integrity, hardness, slough and wear- and crack-resistant characteristics to the bar. A method of preparing the detergent soap composition comprising mixing in a crutcher, the soap, water and FSPP at a temperature above 80° C. and subsequently removing excess moisture at a temperature above about 80° C. for a time sufficient to reduce the total water content of the mixture to from 6–14% by weight, followed by cooling and forming into a bar, is also disclosed.

12 Claims, 3 Drawing Sheets

SOAP COMPOSITION CONTAINING SODIUM PYROPHOSPHATE

RELATED APPLICATIONS

This is a continuation-in-part of application Ser. No. 08/003,152, filed Jan. 11, 1993, now abandoned.

BACKGROUND OF THE INVENTION

1. Field of the Invention

The present invention relates to soap bar compositions having enhanced structural integrity, hardness, slough and wear- and crack-resistant properties.

2. Discussion of the Prior Art

The solubility of soaps in water is generally very high, especially when they contain high levels of salts of unsaturated fatty acids (oleate and linoleate). Soaps derived from high levels of coconut oil have high wear properties, and they possess poor slough characteristics. These soaps produce good lather and are resistant to crack; however, rate of wear and slough properties are important attributes in a soap bar. Structurants or fillers have been commonly used in detergent bars to improve the properties of the bar. They are used to provide structural integrity, as well as to improve the physical properties of the soap bars in which they are incorporated. For example, electrolytes (sodium chloride) and various polymers have been added to soap bars to improve the wear characteristics by salting out the liquid phase in the bar. However, the resulting soaps have poor lather and increased tendency to crack.

Tetrasodium pyrophosphate (TSPP) has been previously used in detergent bar formulations as a filler. It has low solubility in water (7–8% at room temperature), high transition temperature (80° C.) and absorbs water (60% of its weight). On recrystallization, TSPP forms long needle and hexagonal platelets.

U.S. Pat. No. 2,686,761, for example, discloses the addition of TSPP to soap bar compositions containing high moisture levels, i.e., greater than 20% by weight. The TSPP is combined with the high moisture content soap in the crutcher; however, the mixture must be subjected to rigorous kneading, shearing and compacting to result in a "salting-out" of the molten soap and water so as to produce a bar having milled soap properties and which is waxy, translucent and predominantly in the beta phase.

The resulting bar has a high total water content, however, at a cost of reduced soap content. In addition, the presence of excess moisture in the bar leads to an increased tendency to crack. Those skilled in the art will appreciate that the TSPP functions as an inert filler in the soap bar disclosed in U.S. Pat. No. 2,686,761, thereby enabling the provision of a composition containing more water and less soap with inferior structural properties.

U.S. Pat. No. 4,308,158 relates to a synthetic surfactant composition containing a builder which comprises a mixture of alkali metal orthophosphate, alkali metal pyrophosphate and alkali metal tripolyphosphate.

U.S. Pat. No. 3,639,286 discloses the addition of an alkali metal trimetaphosphate to a synthetic detergent bar or cake to absorb the water content thereof such that the final water content is as water of crystallization of the tripolyphosphate salt.

U.S. Pat. No. 3,494,869 describes a superfatted soap bar containing an acidulating agent which may comprise a phosphorous acid or a strong acid salt thereof. The acidulating agent is present to react with the constituent soaps to form free fatty acids in situ.

U.S. Pat. No. 2,868,731 discloses the inclusion of TSPP in non-soap detergent bars to function as a "filler."

U.S. Pat. Nos. 2,970,116 and 3,274,119 relate to a transparent soap bar having a high moisture content and containing an electrolyte including sodium tripolyphosphate to salt out the water.

U.S. Pat. No. 3,370,015 discloses strong, fast-dissolving detergent tablets containing a hydratable condensed phosphate such as TSPP.

U.S. Pat. No. 4,297,230 describes a noncrystallizing transparent soap bar containing 4 to 20% potassium soap and an electrolyte which may comprise tetrasodium pyrophosphate.

U.S. Pat. No. 3,344,076 relates to detergent tablets or briquettes containing at least 20% by weight of a phosphate component (tetrapotassium pyrophosphate or pentasodium or pentapotassium tripolyphosphate). The tablets are designed to have a high rate of disintegration and solubilization in washing machines.

U.S. Pat. No. 3,798,181 discloses an enzymatic detergent bar useful for washing laundry and containing, as a builder, tetrapotassium pyrophosphate.

It is an object of the present invention to provide a soap detergent bar having a low moisture content and enhanced structural integrity, hardness, slough and wear- and crack-resistant characteristics.

SUMMARY OF THE INVENTION

The above and other objects are realized by the present invention, one embodiment of which is a detergent soap composition in bar form comprising (1) an alkali metal or ammonium salt of a saturated or unsaturated fatty acid or mixture thereof, (2) no more than about 14% by weight of total water, and (3) from about 0.5 to about 15% by weight of a structurant selected from the group consisting of tetrasodium pyrophosphate, a hydrate of tetrasodium pyrophosphate and mixtures thereof; the structurant providing enhanced structural integrity, hardness, slough and wear- and crack-resistant characteristics thereto.

An additional embodiment of the invention is a method of preparing the above-described detergent soap composition comprising mixing in a crutcher the alkali metal or ammonium salt of a saturated or unsaturated fatty acid or mixture thereof, water and at least a portion of the tetrasodium pyrophosphate at a temperature above about 80° C. and then vacuum drying to a final moisture level of 6–14% while maintaining the soap temperature above 80° C.

It is a further option in both embodiments of the invention to have no more than 12 wt % moisture.

DETAILED DESCRIPTION OF THE INVENTION

Figure 1:
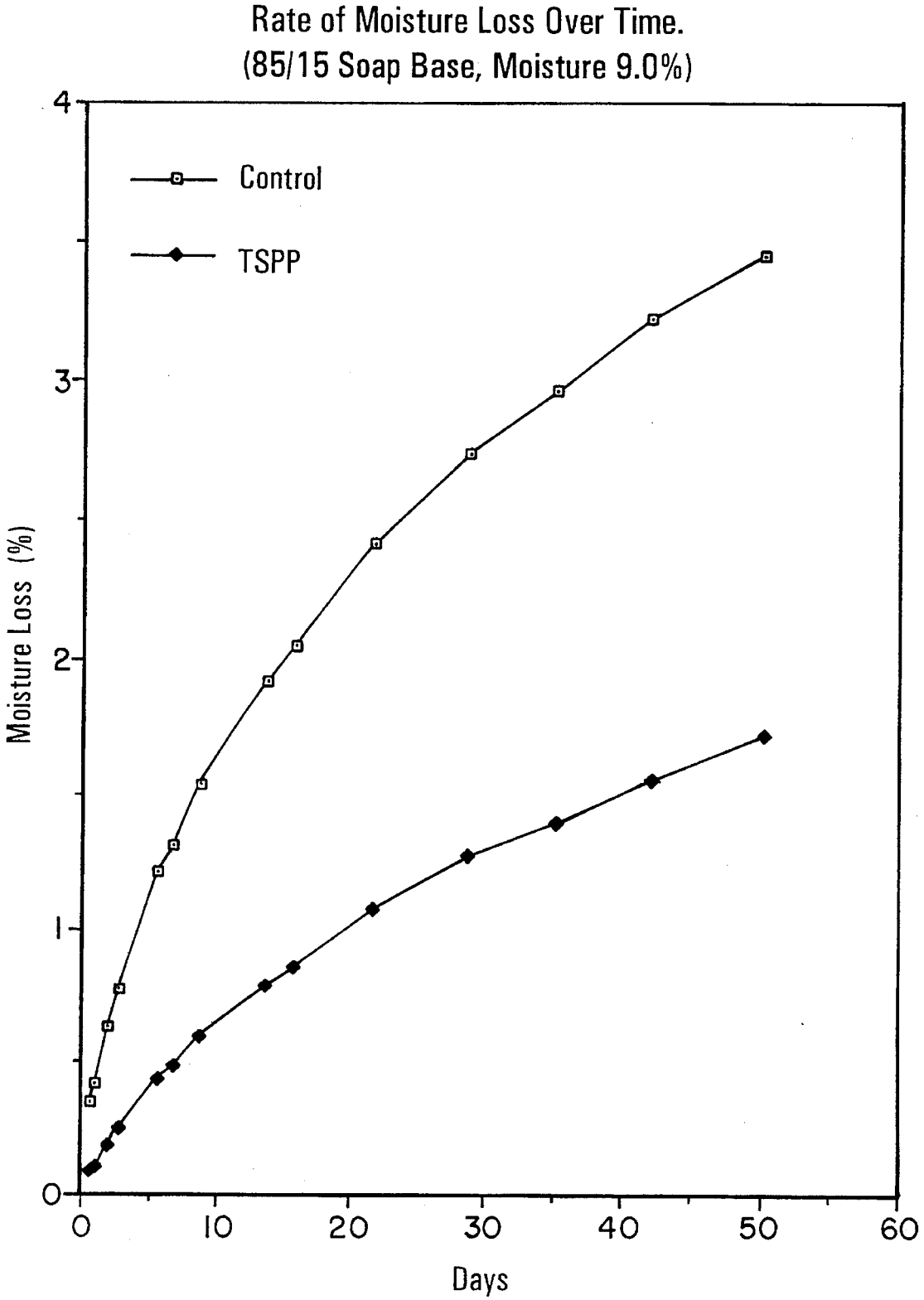
FIGS. 1 and 2 graphically compare rates of moisture loss over time of soap bars of the invention containing TSPP compound with a control bar containing no TSPP.

The present invention is predicated on the discovery that tetrasodium pyrophosphate (TSPP) uniquely enhances the structural integrity and physical properties of soap detergent bars having 6–14% moisture levels. In addition, TSPP also improves the processability of the soap compositions in which it is incorporated to form detergent bars or cakes. The bars made in accordance with the invention are opaque.

As demonstrated by the above-discussed prior art, TSPP has been incorporated in soap detergent bars. However, its use has been limited to soaps of specific fatty acid compositions having high moisture content, wherein it functions as a filler. Thus, the above-discussed U.S. Pat. No. 2,686,761 describes a process which, by adding TSPP to the soap composition under certain processing conditions, enables the production of a soap bar containing a high proportion of water at the expense of a lower proportion of soap. Moreover, the resulting soap bar is predominantly in the beta phase. It is well known that, in high moisture (20–40%) soap bars, the rate of wear increases as the percentage of beta phase increases. In addition, the process described in U.S. Pat. No. 2,686,761 is applicable only to a certain class of fatty acid soaps (i.e., soap of a fat stock of iodine value above 25 and wherein not more than 40% of the combined fatty acids of which are saturated and of less than 16 carbon atoms and at least 20% of the combined fatty acids of which are saturated and of from 16 to 22 carbon atoms). Also the composition containing soap, water and TSPP must be subjected to extreme conditions of shear following mixing in the crutcher to achieve the desired "milled soap properties" and predominantly beta phase. It also appears that the use of the above-described limited class of fatty acid soaps is critical for the formation of the beta phase in the resulting soap bars.

As will be apparent to those skilled in the art, TSPP functions in the soap bar compositions of U.S. Pat. No. 2,686,761 strictly as a filler and as a "salting-out" agent to enable the production of bars containing large amounts of water and low proportions of soap which are in the beta phase.

In the soap bars of the present invention, TSPP functions in an entirely different manner. First, the invention is applicable to all fatty soaps used in manufacturing soap detergent bars.

Moreover, the TSPP functions not merely as a filler enabling the production of soap bars containing a high amount of water, but rather as a functional reagent which enables the production of a low water content soap detergent bar and which effectively enhances many of the physical properties of the bar.

In addition, the TSPP acts as a processing aid in the formation of the detergent bars.

Finally, it is not necessary as in the process described in U.S. Pat. No. 2,686,761 to subject the soap/$H_2O$/TSPP mixture from the crutcher to high shear to obtain the desired product.

While it is in no way intended to limit the invention described herein by the soundness or accuracy of any theories set forth to explain the nature or function of the invention, it is postulated that the highly advantageous properties of the opaque soap detergent bars of the invention are produced by the unique method of mixing the components of the composition in the crutcher and drying the resulting mixture. Thus, it is critical to the success of the invention that at least a portion, and preferably all, of the TSPP be added to the soap mixture in the crutcher. At least enough TSPP should be added in the crutcher to achieve the enhancements observed in the bar. The mixture is then heated to a temperature above about 80° C., the transition temperature of the hydrate of TSPP, and dried under vacuum at that temperature to a final moisture level of 6–14%. It is critical to the success of the invention that the excess moisture be removed during the drying step at a temperature above the transition temperature of TSPP, i.e., 80° C.

Also, the TSPP and remaining TSPP hydrate in the finished bars are believed to form long needle and hexagonal platelet crystals throughout the soap bar structure, thereby forming what amounts to a fibrous-type matrix network therein. This reinforcing network of TSPP and TSPP hydrate crystals is believed to provide the enhanced structural integrity, hardness, slough and wear- and crack-resistant properties associated with the opaque soap detergent bars of the invention. The tetrapotassium pyrophosphate does not form the fibrous-type matrix.

Any fatty acid or mixture thereof, whether saturated or unsaturated, conventionally employed to prepare soap detergent bars may be employed in the practice of the invention. Those skilled in the art, given the principles of the invention described herein, will appreciate that the nature of the particular fatty acids employed to prepare the soap/TSPP/$H_2O$ mixture is not overly critical. Exemplary of suitable such fatty acids from which the soaps (preferably sodium salts) are derived are fatty acids with alkyl chain lengths of C8 to C22, and preferably C12 to C18.

Preferred fatty acids are those derived from tallow/coconut blends wherein the ratio of tallow/coco soap ranges from 1:1 to 9:1. Coco soap is interchangeable with palm kernel oil soap. Tallow soap is interchangeable with palm derived soap, or any other hardened soap derived from C16 and above fatty acids. From about 1–93 wt % of the bar can be soap but usually at least 50 wt %, preferably 75 wt % of the bar is soap.

The TSPP may be added to the kettle soap or therewith when the latter is fed to the crutcher, or it may be added to the crutcher following addition of the soap. In a preferred embodiment, most of the TSPP is added to the crutcher with the soap and the remainder is added in the amalgamator.

As noted above, it is critical to the success of the invention to heat the soap/TSPP/$H_2O$ mixture to a temperature above the transition temperature of TSPP hydrate, and then to dry the soap mixture to a final total water content in the range of 6–14% by weight at a temperature above about 80° C.

Adjuvants typically employed in the preparation of detergent soap bars may, of course, be added to the compositions of the invention. Exemplary of such adjuvants are: chelating agents such as EDTA, DTPA; opacifiers, e.g., $TiO_2$; brighteners such as Tinopal; and fillers, e.g., talc, kaolin, etc.

The invention is illustrated by the following nonlimiting example.

EXAMPLE

Batches comprising the following components were run through the crutcher and amalgamator.

| Ingredients | Weight % |
|---|---|
| Crutcher Formula (Soap Chips) | |
| Neat Soap (85% tallow/15% coco) | 96.95–100 |
| TSPP | 0–3 |
| EDTA $(Na)_4$ | 0.03 |
| BHT (butylated hydroxytoluene) | 0.02 |
| Amalgamator Formula | |
| Soap chips | 98.5 |
| Perfume | 1.5 |

Neat soap (30% moisture) was melted in a kettle at 80° C. Anhydrous tetrasodium pyrophosphate (TSPP) was added to the soap at 80° C. and the mixture was mixed for 30 minutes.

Soap chips were prepared from this mixture by drying under vacuum to 6–14% moisture between 90°–110° C.

The soap chips were mixed with perfume and colorants, milled on a roll mill three times and plodded. The bars were then pressed into brick shape.

A total of 7 batches were prepared using 85/15 tallow/coco soap (see Table 1). Batches 1 and 2 were made with and without 3% TSPP. The final moisture in the bars was maintained at approximately 8% and TSPP was added in the crutcher. Batches 3–5 were made with 9–10% moisture content in the soap bar with and without 3% TSPP, and TSPP was added in the crutcher. In Batch 5, an additional 1.5% TSPP was added in the amalgamator. Batches 6 and 7 were made with and without 3% TSPP, and TSPP was added in the amalgamator.

Figure 2:
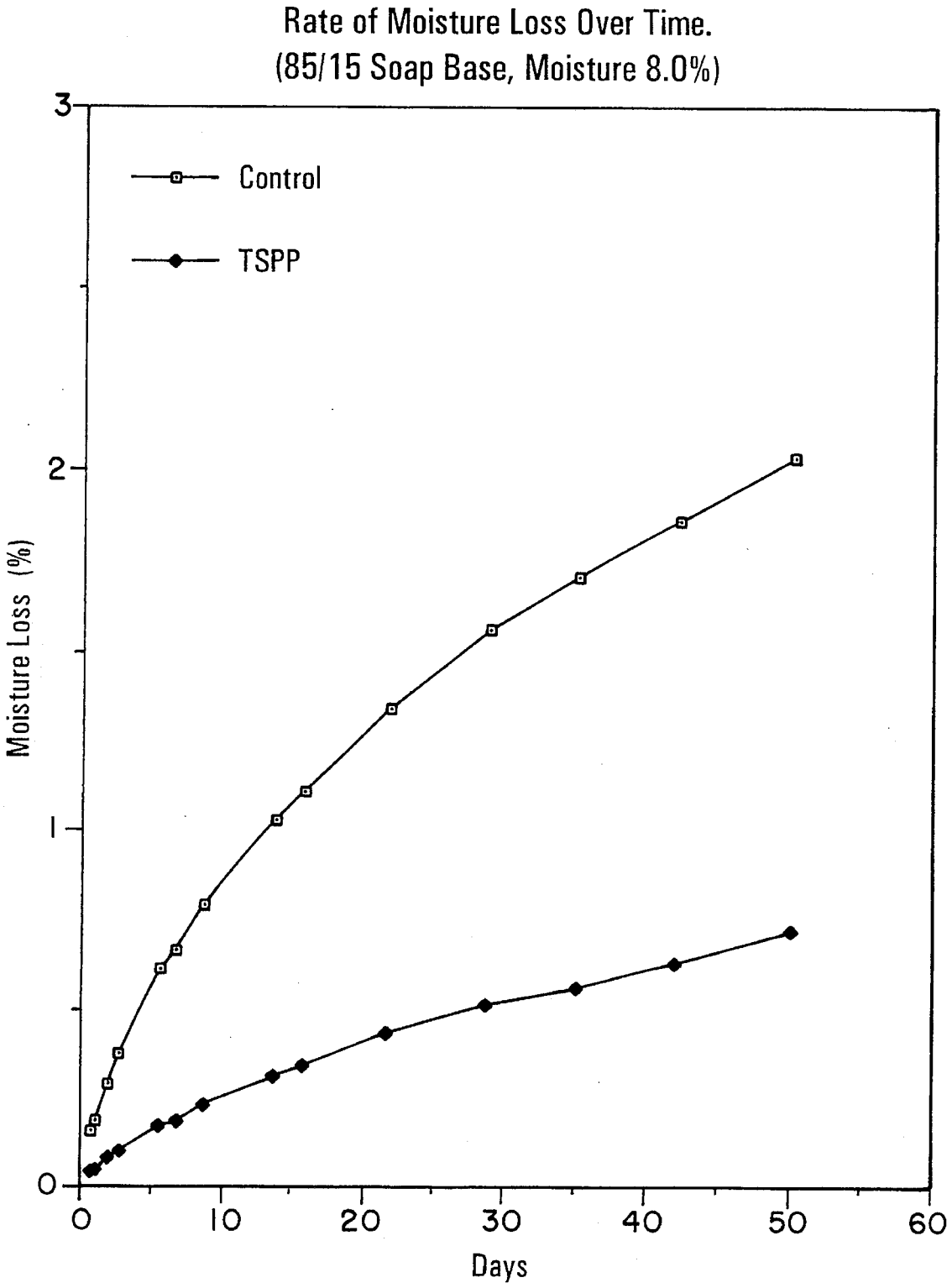

Different bar attributes (moisture, hardness, cracking, dry specks, slough, wear rate and moisture loss) were measured for the various formulations under similar controlled conditions (see Table 1). The rate of moisture loss was measured by weighing the bars at regular intervals (see FIGS. 1 and 2).

The following terms and definitions are used herein:

Volatiles - The volatiles are reported as percent weight loss. This loss equals water plus fragrance and other volatiles lost during heating using a vacuum oven (180° F., 25" Hg).

Hardness - The bar hardness was determined using the needle penetrometer. This apparatus uses a weighted needle point, and the depth of penetration into the soap surface was measured for a 10-second interval. A minimum of ten data points were taken, and average results are given in millimeters. The results provide a relative assessment of bar hardness.

Wet Crack - The soap bars were suspended in tap water at room temperature (~75° F.) for 4 hours and then allowed to dry for 24 hours prior to being evaluated. Any resulting cracks on the bar surface were rated numerically using a scale of zero (none) to 5 (severe) and then summed. For example, a soap bar having 5 cracks of severity 1, plus 2 cracks of severity 4, has a total rating of 13. A total rating of more than 25 is considered unacceptable.

Dry Specks - The graininess of the bars was determined by washing the bars in water using a temperature range from 55° to 85° F. The bars were evaluated and rated every 15° F. A rating of 0–25 is acceptable, and values of increasing and unacceptable specks are 50, 75 and 100.

Slough (low humidity, room temperature) - The initial weights of the soap bars were recorded. The bars were placed in plastic soap dishes (120 mm×75 mm×16 mm) filled with tap water at room temperature. The soap remained in the water for 17 hours. The soft soap was then removed by hand, and the bars were dried at room temperature for 24 hours and weighed. The test results are given as the weight loss per 100 grams.

Slough Test (high humidity) - The weight of the bar was recorded in grams. The bars were washed twice at 30 minute intervals for 10 seconds at 100° F. before testing. The bar was placed in a soap dish (120 mm×75 mm×16 mm). The dish was filled with tap water, and the bar remained in the water for 17 hours at 35–40° C. at 100% relative humidity. At the end of 17 hours, the resulting soft material (slough) was removed using finger pressure. The bar was air-dried for 24 hours at 21°–25° C., after which the bar weight was recorded. The weight loss was determined as the loss per 100 grams.

Wear By Repeated Hand Wash - In this second method, the soap bars were repeatedly washed and then allowed to dry. The test was carried out over a 4-day period in order to simulate at-home usage. The initial weights of the bars were recorded. A few different individuals washed the bars for 10-second intervals in warm tap water (90°–100° F.). The soap bars were placed in a soap dish with a grid to allow drainage of water. The bars were allowed to dry for at least a 30-minute interval between washings. The soap bars underwent a total of 20 washes of 10-second duration, and were then dried for 24 hours prior to reweighing. The results were reported both as weight loss per 100 grams, as well as per use.

TABLE 1

Bar Properties of 85/15 Base With TSPP As Filler

| Batch No. | | Moisture Vacuum Oven Overnight High Temperature | Hardness Needle Pene-trometer | Cracking 4 hr. Wet Soak 24 hr. Dry Time | Dry Specks Washed Down Bar | Slough @ RT 17 hr. Soak 24 hr. Dry Time | Slough High RH Prewashed Twice 17. hr Soak 24 hr. Dry Time | Wear Rate 10 sec. Wash 20 Uses 24 hr. Dry Time | Wear Rate Loss Per Use |
|---|---|---|---|---|---|---|---|---|---|
| 1 | 85/15 Base Control | 8.04% | 3.84 mm | 19.50 Heavy in appearance | 80F rating 25<br>70F sandy 25<br>55F grit 25 | 14.07% | 20.68% | 24.05% | 1.20 g |
| 2 | 85/15 Base 3% TSPP Crutcher | 7.49% | 2.76 mm | 10.00 Slight to Moderate in appearance | 80F drag<br>70F drag 25<br>55F sandy 25 | 11.55% | 18.17% | 16.17% | 0.81 g |
| 3 | 85/15 Base Control | 9.74% | 4.54 mm | 19.00 Moderate in appearance | 80F rating 25<br>70F grit 25<br>55F rough 50 | 16.50% | 24.47% | 22.65% | 1.13 g |
| 4 | 85/15 Base 3% TSPP Crutcher | 8.72% | 3.49 mm | 13.00 Slight in appearance | 80F drag<br>70F fine<br>55F sandy 25<br>grit 25 | 11.65% | 19.95% | 17.77% | 0.89 g |
| 5 | 85/15 Base 3% TSPP Crutcher 1.5% TSPP Amalgamator | 10.06% | 3.61 mm | 7.00 Slight to Moderate in appearance | 80F sandy 25<br>70F grit 25<br>55F grit 25 | 10.72% | 17.46% | 17.07% | 0.85 g |

TABLE 1-continued

| Bar Properties of 85/15 Base With TSPP As Filler | | | | | | | | | | |
|---|---|---|---|---|---|---|---|---|---|---|
| Batch No. | | Moisture Vacuum Oven Overnight High Temperature | Hardness Needle Pene-trometer | Cracking 4 hr. Wet Soak 24 hr. Dry Time | Dry Specks Washed Down Bar | | Slough @ RT 17 hr. Soak 24 hr. Dry Time | Slough High RH Prewashed Twice 17. hr Soak 24 hr. Dry Time | Wear Rate 10 sec. Wash 20 Uses 24 hr. Dry Time | Wear Rate Loss Per Use |
| 6 | 85/15 Base Control | 6.33% | 3.23 mm | 2.00 Good appearance | | | 10.99% | 21.15% | 22.44% | 1.12 g |
| 7 | 85/15 Base 3% TSPP Amalgamator | 7.15% | 3.46 mm | 0.00 Perfect | 80F<br>70F<br>55F | rating 25 sandy some grit 25 grit 50 | 9.49% | 20.04% | 22.86% | 1.14 g |

NOTE: Data is averaged.

The performance benefits from TSPP are observed only when it is added to neat soap, and the excess moisture is subsequently removed under vacuum while maintaining the temperature above 80° C. In other words, addition of TSPP to predried soap chips in the amalgamator may reduce the total soap content, but not necessarily improve bar properties such as hardness, slough and use-up. In Table 1 above, Batch 7 corresponds to the bars made with TSPP added in the amalgamator. Comparing its values to the control (Batch 6), it is clear that TSPP added in the amalgamator has no major impact on overall performance. The key benefits of TSPP added in the crutcher are summarized in Table 2 below.

TABLE 2

| Improvement of Bar Attributes In TSPP-Containing Bars | | |
|---|---|---|
| | TSPP Addition | |
| | Amalgamator vs. Control | Crutcher vs. Control |
| Hardness | = | + |
| Cracking | + | + |
| Dry Specks | − | = |
| Slough (low humidity) | = | ++ |
| Slough (high humidity) | = | ++ |
| Wear | = | ++ |
| Moisture Loss | + | ++ |

= No significant difference.
± Significant difference.

The slough properties of bars containing TSPP were superior to the bars without TSPP (both in high and low humidity testing conditions). The hardness of bars improved with the addition of TSPP and bars with TSPP were better in crack resistance. The wear rate decreased in soap bars containing TSPP and the rate of moisture loss from bars containing TSPP was slower than the control bars.

Mapping of Water in TSPP Soap Bars

It is well known that TSPP forms a hydrate with water and absorbs water up to 60% of its weight. The mapping of the water content of soap bars was studied by Differential Scanning Calorimeter (DSC). The total water content was obtained by drying the samples in a vacuum oven at 180° F. for 24 hours, whereas the free water was calculated from the endothermic transition of melting of ice in the soap samples by DSC. The difference between the total moisture and the free water is the total bound water in the soap bars. Soap water was then calculated from the total bound and TSPP water content in the soap (see Table 3).

TABLE 3

| Mapping of Water in Soap (70% Tallow/30% Coco) with TSPP | | | | | |
|---|---|---|---|---|---|
| TSPP (%) | Free Water (%) | Total Water (%) | Total Bound (%) | TSPP Water (%) | Soap Water (%) |
| 0 | 17.6 | 28.6 | 11.0 | 0 | 11.0 |
| 4.8 | 12.6 | 26.1 | 13.5 | 2.9 | 10.6 |
| 9.1 | 11.5 | 23.0 | 11.5 | 5.5 | 6.0 |
| 13.0 | 3.7 | 19.3 | 15.9 | 7.8 | 8.1 |
| 15.7 | 3.9 | 20.9 | 17.0 | 9.4 | 7.6 |
| 23.0 | — | 20.4 | 20.4 | 13.8 | 6.6 |
| 28.6 | — | 19.4 | 19.4 | 17.2 | — |
| 33.3 | — | 17.8 | 17.8 | 20.0 | — |

Figure 3:
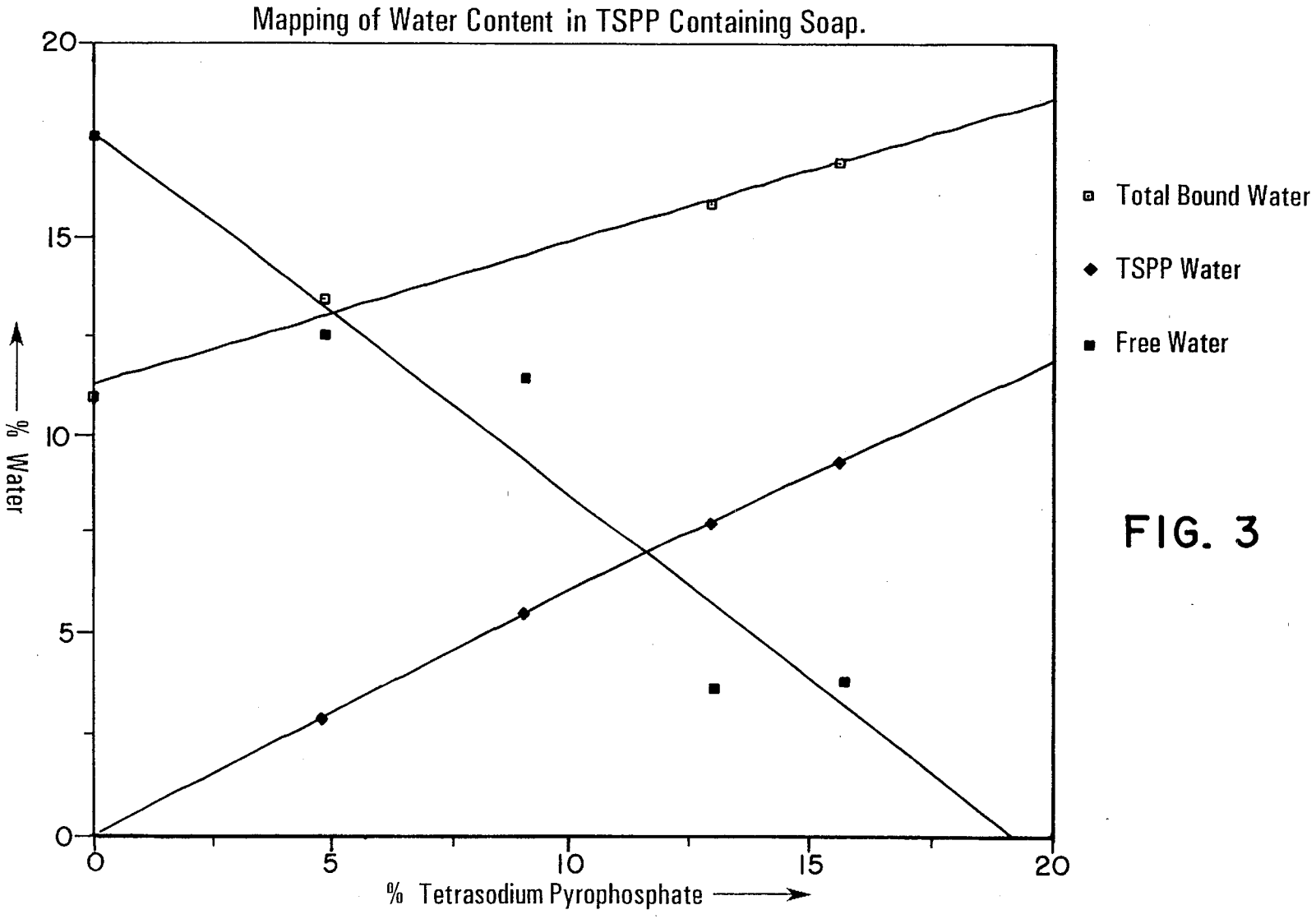
FIG. 3 graphically depicts mapping of water content in soap bars containing TSPP.

Total bound, TSPP hydrate and free water content in soap bars were observed to vary linearly with TSPP concentration, consistent with 10 moles of water absorbed by 1 mole of anhydrous TSPP (see FIG. 3).

Phosphorus Distribution in the Bar

The flat (cleaved) regions of the soap bars were elementally characterized both in a qualitative fashion and by elemental distribution (dot map or elemental) surveys by energy dispersive X-ray analysis (EDX). The following combar samples were prepared with tallow coco soap base with 0–25% synthetic surfactants selected from anionic surfactants (cocomonoglyceridesulfate, sodium cocoyl isethionate, alkylglycerylsulfonate) and analyzed by EDX:

Sample #1 - TSPP (4%) added in the amalgamator

Sample #2 - TSPP (0%)

Sample #3 - TSPP (3%) added in the crutcher

Sample #4 - TSPP (4%) added in the crutcher.

In sample #2, phosphorus was not detected in significant amounts. In the survey region for sample #1, elemental dot mapping indicated that phosphorus was concentrated unevenly, whereas in sample #3 and sample #4, phosphorus appeared to be evenly distributed in small clusters.

The four samples of tallow/coco (85%/15%) were also examined for phosphorus distribution on the surface of soap bars before and after wear (20 washes) by EDX to observe the effect of wear on the mode of addition of TSPP.

1. Sample #1 - 3% TSPP added in the crutcher
2. Sample #1 - wear-tested
3. Sample #2 - 3% TSPP added in the amalgamator)
4. Sample #2 - wear-tested.

In the soap bars (sample #1) which were prepared by adding TSPP in the crutcher and dried at high temperature, an even distribution of phosphorus was detected as compared to soap bars (sample #2) which were prepared by adding TSPP in the amalgamator. After both samples were wear-tested, the phosphorus concentration in sample #2 was considerably lower compared to sample #1. These results indicate the formation of a network inside the soap bar when TSPP was added in the crutcher and dried at high temperature.

The addition of TSPP in the crutcher followed by drying the soap chips at high temperature produced soap bars with TSPP evenly distributed throughout the bar. The reduction of slough and wear in these bars is related to the modification of the surface properties of these bars by the addition of TSPP.

Bars processed with 2–4% TSPP had improved slough, reduced wear and were less likely to develop crack compared to bars without TSPP. These results are also in compliance with the presence of TSPP as a structurant in the bars.

Solid Phases in Soap Bars

Soap bars prepared with and without TSPP were analyzed for different phases by X-ray diffraction pattern. Soap bars without TSPP have predominantly omega phase with 9–14% beta phase. However, the beta phase in TSPP-containing soap bars could not be determined as the diffraction pattern of TSPP blocks the region where beta phase is generally observed. Therefore, it is not possible to quantify the beta phase in TSPP-containing soap bars.

Effect of Temperature on Addition of TSPP in Soap

The effect of temperature on the success of adding TSPP was examined at different temperatures. Anhydrous (5%) or TSPP slurry (20% in water) was added to the neat soap 85/15 tallow/coco, (30% moisture) and was examined at 25° C., 65° C., 70° C. and 90° C. The TSPP and soap were mixed for 10–15 minutes after the soap had reached the desired temperature and samples then studied by differential scanning calorimetry (DSC) for formation of TSPP hydrate. Through use of DSC it was noted that very little TSPP hydrate is formed at 25° and 65° C. Considerably more hydrate is formed at 90° C. than 70° C.

As stated previously, it is believed that the TSPP hydrate forms a three dimensional network inside the bar and is responsible for the improvement in the physical properties (cracking, slough and use-up) of soap bars observed in this invention. Tetra potassium pyrophosphate does not form a stable hydrate at these temperatures wherein TSPP hydrate is formed.

Thus, according to the present invention, there are provided detergent soap bars containing TSPP which, due to the manner in which it is incorporated into the bars, acts as a functional reagent and structurant rather than merely as a filler, enabling the production of bars having high water and low soap contents.

We claim:

1. A detergent soap composition in bar form comprising:

(a) about 75 to about 93 wt % of an alkali metal or ammonium salt of a saturated or unsaturated fatty acid or mixture thereof;

(b) a moisture content in the range of from about 6% to 14% by weight; and (c) from about 2 to about 4% by weight of a structurant selected from the group consisting of tetrasodium pyrophosphate, a hydrate of tetrasodium pyrophosphate and mixtures thereof;

said structurant providing enhanced structural integrity, hardness, slough and wear- and crack-resistant characteristics thereto.

2. The composition of claim 1 wherein said soap comprises a salt of a saturated fatty acid having from C8 to C20 carbon atoms or a mixture thereof.

3. The composition of claim 1 wherein said soap comprises a soap derived from a tallow/coconut fatty acid blend wherein the ratio of tallow/coco soap is in the range of from about 1:1 to about 9:1.

4. The composition in accordance with claim 1 wherein the bar is opaque.

5. The composition in accordance with claim 1 wherein the maximum amount of moisture is 12 wt %.

6. A method for personally cleansing the skin which comprises applying to the skin the composition of claim 1.

7. A method of preparing the detergent soap composition of claim 1 comprising mixing in a crutcher said salt of a saturated or unsaturated fatty acid or mixture thereof, water and at least a portion of said tetrasodium pyrophosphate at a temperature above about 80° C. and subsequently removing excess moisture from the resulting mixture under vacuum while maintaining the temperature above about 80° C. to a final moisture content in the range of from about 6% to 14% said portion of sufficient quantity to bring about enhanced structural integrity, hardness, slough and wear- and crack-resistant characteristics to the bar.

8. The method of claim 7, wherein substantially all of said tetrasodium pyrophosphate is added to the crutcher.

9. The method in accordance with claim 7 wherein the maximum amount of moisture is 12 wt %.

10. A method for personally cleansing skin which comprises applying to the skin the composition prepared according to the method of claim 7.

11. A detergent soap composition in bar form comprising:

(a) about 1 to about 93 wt % of an alkali metal or ammonium salt of a saturated or unsaturated fatty acid or mixture thereof;

(b) a moisture content in the range of from about 6% to 14% weight; and (c) from about 2 to about 4% by weight of a structurant selected from the group consisting of tetrasodium pyrophosphate, a hydrate of tetrasodium pyrophosphate and mixtures thereof.

12. The composition in accordance with claim 11 wherein the composition is opaque.

* * * * *